US006422210B1

(12) United States Patent
Lambert et al.

(10) Patent No.: US 6,422,210 B1
(45) Date of Patent: Jul. 23, 2002

(54) FUEL INJECTOR

(75) Inventors: Malcolm David Dick Lambert, Bromley; Michael Peter Cooke; Martin Paul Hardy, both of Gillingham; Trevor Alan Fuller, Maidstone, all of (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/637,731

(22) Filed: Aug. 11, 2000

(30) Foreign Application Priority Data

Aug. 20, 1999 (GB) ..... 9919660

(51) Int. Cl.[7] ..... F02M 37/04

(52) U.S. Cl. ..... 123/496; 239/88; 239/89; 123/498

(58) Field of Search ..... 123/299, 496, 123/498, 467; 239/88, 89, 102.1, 102.2, 533.1–533.12

(56) References Cited

U.S. PATENT DOCUMENTS 5,901,685 A * 5/1999 Noyce et al. ..... 123/467
6,196,472 B1 * 3/2001 Cooke ..... 239/88
6,216,964 B1 * 4/2001 Lambert ..... 239/533.12
6,224,001 B1 * 5/2001 Cooke et al. ..... 239/533.12

* cited by examiner

*Primary Examiner*—Willis R. Wolfe
*Assistant Examiner*—Mahmoud Gimie
(74) *Attorney, Agent, or Firm*—Thomas N. Twomey

(57) ABSTRACT

A fuel injector comprising a valve needle which is slidable within a bore and engageable with a seating to control fuel delivery through first and second outlet openings. The valve needle is moveable between a closed position and first and second fuel injecting positions. The fuel injector further comprises a fuel supply passage for supplying fuel under pressure to the bore and a control chamber which is arranged to receive fuel from the fuel passage, in use. The valve needle is acted upon in use by a force due to fuel pressure within the control chamber. An actuator arrangement controls fuel pressure within the control chamber, and a damping means are provided for damping movement of the valve needle away from the seating into the first or second fuel injecting position. The supply passage for fuel may be provided with a restricted flow passage which serves to limit the amplitude of pressure waves within the supply passage.

16 Claims, 3 Drawing Sheets

FUEL INJECTOR

TECHNICAL FIELD

This invention relates to a fuel injector for use in supplying fuel to a combustion space of an internal combustion engine. Such a fuel injector may be suitable for use in, for example, a common rail type fuel system and for control by an electronic control arrangement.

BACKGROUND OF THE INVENTION

It is often a requirement to be able to vary the rate at which fuel is delivered by the injector. Commonly, the fuel injection rate is dependent upon the distance by which a valve needle is lifted away from its seating, movement of the valve needle within a bore provided in a nozzle body being controlled by means of a piezoelectric actuator. The piezoelectric actuator is operable to control the position occupied by a control piston, the piston being moveable to control the fuel pressure within a control chamber defined, in part, by a surface associated with the valve needle of the injector to control movement of the valve needle away from its seating. When the valve needle is lifted away from its seating into a first fuel injecting position, a set of upper outlet openings are exposed and fuel is delivered therefrom. When the valve needle is lifted away from its seating into a second fuel injecting position, a set of lower outlet openings are also exposed, fuel thereby being delivered through both sets of outlet openings to increase the fuel injection rate.

A problem with two-stage fuel injectors of the aforementioned type is that, when fuel delivery is to be terminated, the sudden closure of the lower set of outlet openings results in a rapid increase in fuel pressure in the tip of the nozzle body. If the pressure increase coincides with peaks in the pressure waves in the supply drillings, this can lead to an adversely slow closure of the outlet opening. Hence, fuel injection is terminated relatively slowly which can lead to a poor fuel spray characteristic and poor injector performance. Secondly, there is a tendency for the valve needle to oscillate between the first and second fuel injecting positions as there is no mechanical stop to limit the extent of movement of the valve needle away from its seating. This can lead to poor controllability. In addition, it is necessary for movement of the valve needle to the first and second fuel injecting positions to be of a relatively large magnitude to ensure that the valve needle remains in the second fuel injecting position for a period of time which is sufficient to permit an adequate quantity of fuel to be delivered, and also to ensure there is a dead band, when fuel injection takes place through the upper openings only, prior to opening of the lower set of outlet openings.

SUMMARY OF THE INVENTION

It is an object of the present invention to provide a fuel injector which alleviates the aforementioned problems of the prior art.

According to a first aspect of the present invention, there is provided a fuel injector comprising a valve needle which is slidable within a bore and engageable with a seating to control fuel delivery through first and second outlet openings, the valve needle being moveable between a closed position and first and second fuel injecting positions, a fuel supply passage for supplying fuel under pressure to the bore, a control chamber which is arranged to receive fuel from the fuel passage, in use, the valve needle being acted upon in use by fuel pressure within the control chamber, an actuator arrangement for controlling fuel pressure within the control chamber, and damping means for damping movement of the valve needle away from the seating into the first or second fuel injecting position.

By damping movement of the valve needle as it moves away from the seating into either the first or second fuel injecting position, the problem of valve needle oscillation can be obviated or mitigated. In addition, by damping movement of the valve needle away from the seating, the first and second outlet openings can be arranged such that the valve needle need only be moved away from the seating by a relatively small amount into the first and/or second fuel injecting position.

Conveniently, movement of the valve needle away from the seating into the first fuel injecting position causes fuel to be delivered through the first outlet opening and movement of the valve needle away from the seating into the second fuel injecting position causes fuel to be delivered through the first and second outlet openings. Thus, movement of the valve needle into the second fuel injecting position causes fuel to be delivered at an increased rate.

Preferably, the control chamber is divided into a first part associated with the valve needle and a second part associated with the actuator, and the damping means include a flow restrictor which serves to restrict flow of fuel, in use, from the first part of the control chamber to the second part of the control chamber.

The control chamber and flow restrictor may be arranged such that, in use, flow of fuel takes place through the flow restrictor from the second part of the control chamber to the first part of the control chamber. In this embodiment, the flow restrictor is preferably arranged such that there is a relatively lower restriction to fuel flow in this direction.

The flow restrictor may be defined by a drilling provided in a housing part. Conveniently, the flow restrictor may take the form of a restricted flow passage of stepped form or may take the form of a venturi-type flow passage.

The injector may preferably comprise an inner valve needle which is movable within the valve needle upon movement of the valve needle away from the seating beyond a predetermined amount, the inner valve needle being engageable with a further seating to control fuel flow through the second outlet opening.

The supply passage may include an additional restricted flow passage which serves to limit the amplitude of pressure waves within the supply passage. In this way, movement of the valve needle against the seating to terminate fuel injection is not caused to be slowed due to the transmission of large amplitude pressure waves through the supply passage. Preferably, the restricted passage is of a dimension which does not give rise to a substantial decrease in fuel pressure between the inlet and outlet ends of the restricted passage.

According to as second aspect of the invention, there is provided a fuel injector comprising a valve needle which is slidable within a bore and engageable with a seating to control fuel delivery through an outlet opening, a fuel supply passage for supplying fuel under pressure to the bore, a control chamber which is arranged to receive fuel from the fuel passage, in use, the valve needle being acted upon in use by fuel pressure within the control chamber, an actuator arrangement for controlling fuel pressure within the control chamber, wherein the supply passage includes an additional restricted flow passage which serves to limit the amplitude of pressure waves within the supply passage.

BRIEF DESCRIPTION OF THE DRAWINGS

The invention, will now be described, by way of example, with reference to the accompanying drawings, in which.

DESCRIPTION OF THE PREFERRED EMBODIMENT

Figure 1:
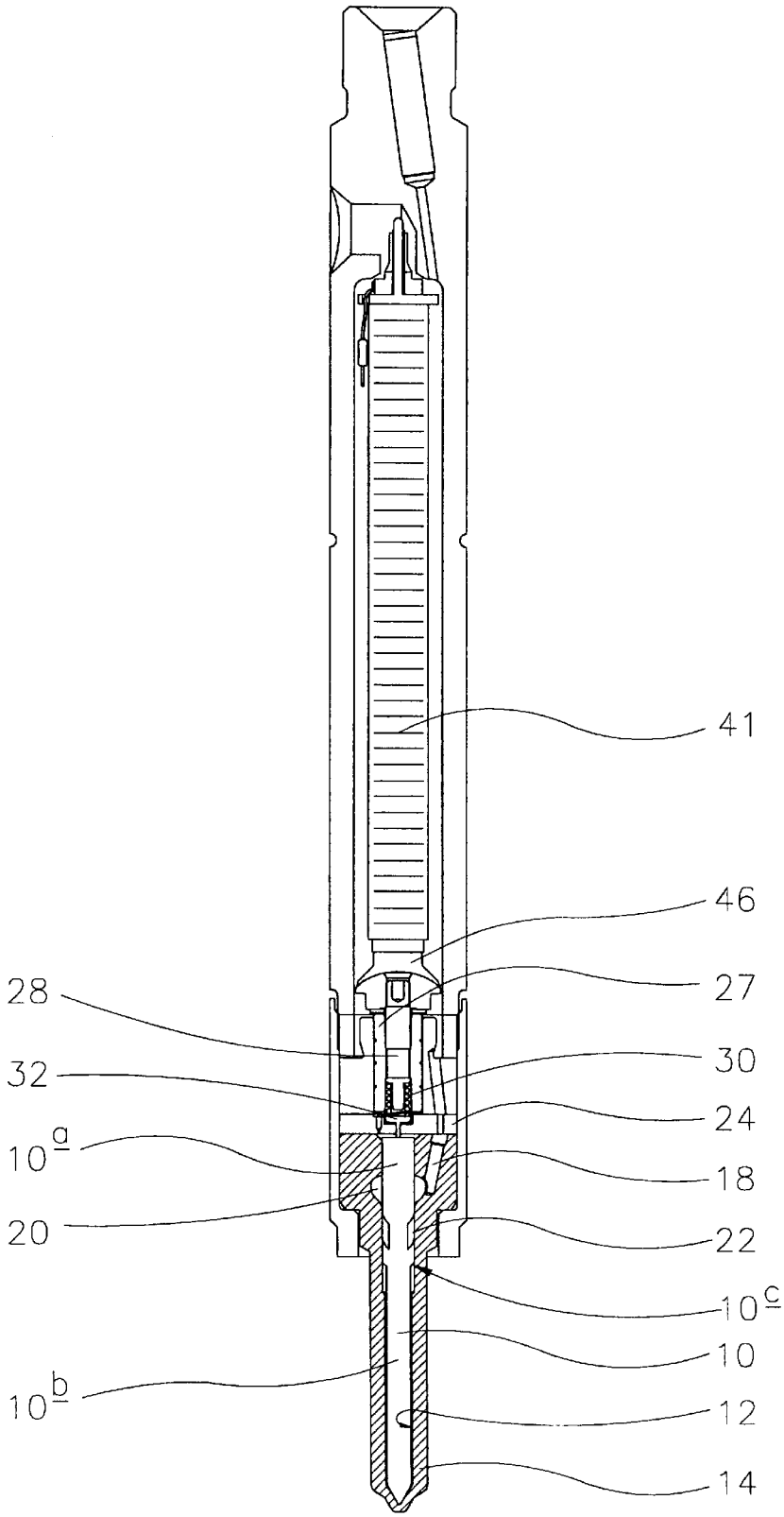
FIG. 1 is a sectional view of a fuel injector according to a first embodiment of the present invention.
Figure 2:
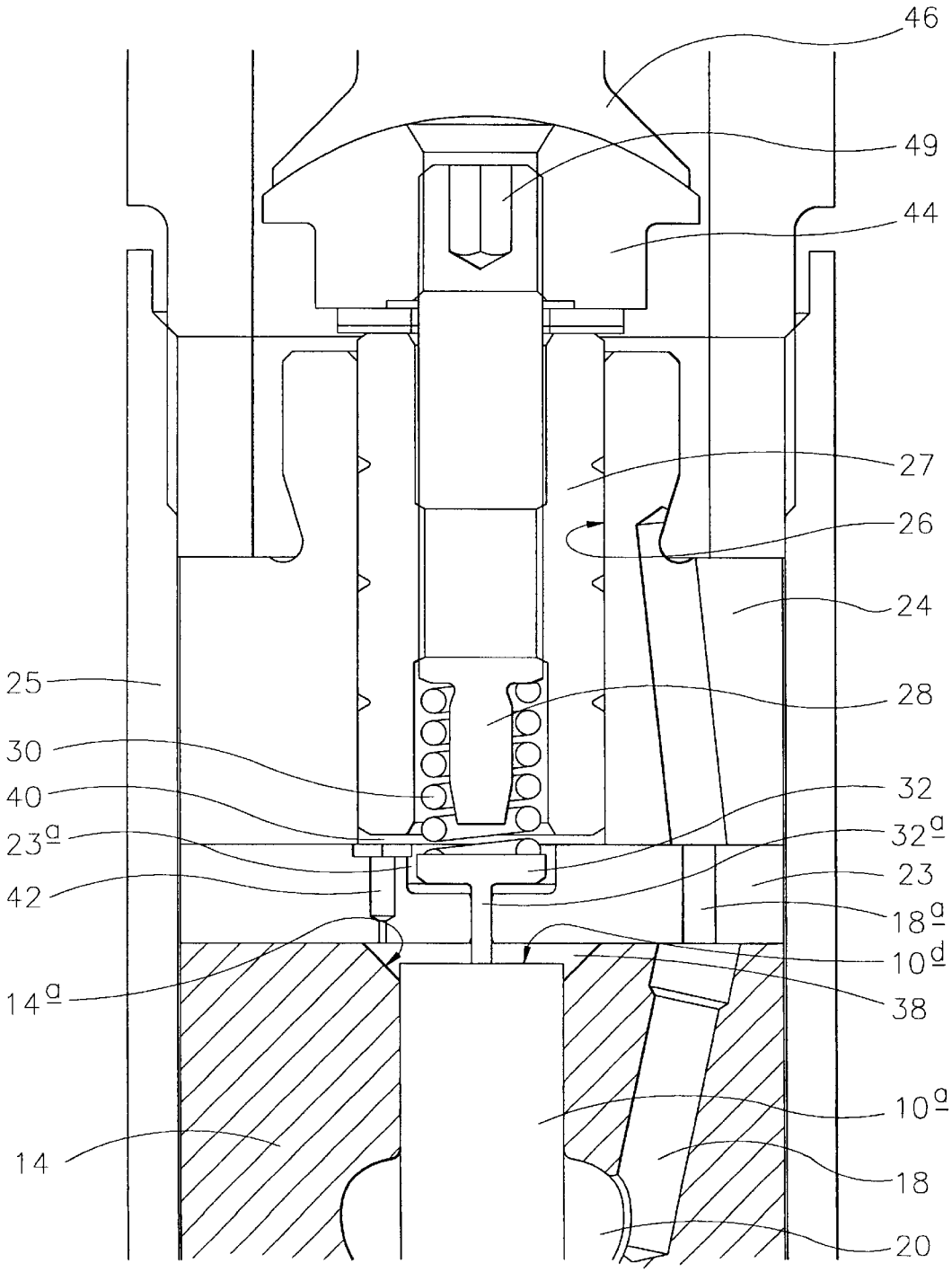
FIG. 2 is an enlarged view of part of the fuel injector of FIG. 1.

Referring to FIGS. 1 and 2, the injector comprises a valve needle 10 slidable within a bore 12 formed in a nozzle body 14. The bore 12 is a blind bore, the blind end of the bore 12 defining a seating with which an end region of the valve needle 10 is engageable to control the supply of fuel from the bore 12 past the seating to upper and lower sets of outlet openings (not shown) provided in the nozzle body 14. The bore 12 is arranged to be supplied with fuel from a source of fuel under high pressure, for example a common rail of a common rail fuel system, through a supply passage 18 which communicates with an annular gallery 20 defined by part of the bore 12. The upper and lower sets of outlet openings occupy different axial positions in the nozzle body 14 such that, when the valve needle is lifted away from its seating into a first fuel injecting position, fuel is only delivered through the upper set of outlet openings and when the valve needle 10 is lifted away from its seating into a second fuel injecting position, fuel is delivered through both the upper and lower sets of outlet openings, as will be described hereinafter. This may be achieved, for example, by providing the valve needle 10 with an inner needle which is moveable with the valve needle 10 upon axial movement of the valve needle 10 beyond a predetermined position, the valve needle 10 controlling injection through the upper outlet openings directly and the inner needle being engageable with a seating to control injection through the lower openings.

The valve needle 10 is of stepped form and includes an upper end region 10*a* of diameter substantially equal to the diameter of the adjacent part of the bore 12, and a lower region 10*b* which is of diameter smaller than the diameter of the bore 12. In order to permit fuel to flow from the annular gallery 20 to the part of the bore 12 containing the reduced diameter region 10*b* of the valve needle 10, the valve needle 10 is provided with grooves or flutes 22. The shape of the valve needle 10 is such as to include thrust surfaces 10*c* orientated such that the application of fuel under pressure to the bore 12 applies a force to the needle 10 urging the needle 10 in an opening direction (upwardly as viewed in FIG. 1) away from its seating.

The upper end of the nozzle body 14 abuts a dividing piece 23 which in turn abuts a distance piece 24, the nozzle body 14, the dividing piece 23 and the distance piece 24 being received within a cap nut 25. The distance piece 24 is provided with a drilling which forms part of the supply passage 18. In addition, the dividing piece 23 is provided with a restricted drilling 18*a* which forms a part of the supply passage 18 of reduced diameter. As can be seen most clearly in FIG. 2, the distance piece 24 is also provided with a through bore 26 within which a piston member 27 is slidable. The piston member 27 is provided with a through bore within which a screw-threaded spring abutment member 28 is received. The spring abutment member 28 engages one end of a compression spring 30. The other end of the spring 30 abuts a load transmitting member 32 which is housed within recess 23*a* provided in an upper end surface of the dividing piece 23. The spring 30 acts in a direction so as to bias the valve needle 10 in a closing direction towards the seating defined by the bore 12.

The load transmitting member 32 includes an axial projection 32*a* which extends through a bore provided in the dividing piece 23 and abuts the valve needle 10 at its uppermost end surface 10*d* such that the spring load is transmitted to the valve needle 10 through the load transmitting member 32. The upper end surface 10*d* of the valve needle 10 is disposed within a recess 14*a* formed in the upper end surface of the nozzle body 14. The diameter of the axial projection 32*a* is substantially the same as the bore provided in the dividing piece 23 so as to guide sliding movement of the member 32 within the bore.

The upper end surface 10*d* of the valve needle 10 which is disposed within the recess 14*a* and the lower surface of the dividing piece 23 together define a first, lower chamber 38 for fuel. Additionally, the bore 26 provided in the distance piece 24, the piston member 27, the abutment member 28 and the recess 23*a* define a second, upper chamber 40 for fuel. The dividing piece 23 is provided with a restricted flow passage 42 which provides communication between the lower chamber 38 and the upper chamber 40. Thus, the piston member 27, the distance piece 24, the dividing piece 23 and the recess 14*a* define, in effect, a control chamber having a first chamber part, in the form of the lower chamber 38 defined between the nozzle body 14 and the dividing piece 23, and a second chamber part, in the form of the upper chamber 40 defined between the piston member 27 and the dividing piece 23, the first and second chamber parts being in mutual communication via the restricted passage 42. The orientation and design of the passage 42 is such that it provides a greater restriction to flow from the lower chamber 38 to the upper chamber 40 than from the upper chamber 40 to the lower chamber 38.

In use, fuel is delivered to the annular chamber 20 through the supply passage 18 and the restricted passage 18*a* from the source of fuel at high pressure. Fuel within the annular chamber 20 is able to flow at a restricted rate into the lower chamber 38 between the valve needle 10 and the adjacent part of the wall of the bore 12. It will be appreciated that such fuel flow is at a restricted rate as the diameters of the needle 10 and the adjacent part of the bore 12 are substantially equal. From the lower chamber 38, fuel is able to flow into the upper chamber 40 via the restricted passage 42.

At the end of the piston 27 remote from the chamber 40, the piston member 27 is secured, by the spring abutment member 28, to an abutment member 44, having a surface of part spherical form, which abuts an anvil member 46, the anvil member 46 forming part of a piezoelectric actuator arrangement which includes a piezoelectric stack 48 of piezo-ceramic elements. The elements of the stack 48 are of the energise-to-extend type such that, when the energisation level of the piezoelectric stack is increased, the axial length of the stack 48 also increases causing a downwardly directed force to be applied to the piston member 27, pressurising the control chamber and applying a downward force to the valve needle 10. De-energisation of the piezoelectric stack 48 causes the axial length of the stack 48 to decrease, thereby reducing the downwards force applied to the valve needle 10. The abutment member 44 is provided with a drilling through which a spring abutment member 28 extends. The spring abutment member 28 is provided with a recess 49 shaped for cooperation with a tool to permit adjustment of the axial position of the spring abutment member 28 relative to the piston member 27.

In use, upon starting the engine, the fuel pressure supplied to the supply passage 18 is relatively low, thus the force acting on the thrust surfaces 10*c* of the valve needle to urge the valve needle 10 away from its seating is also relatively low, the spring 30 providing sufficient force to ensure that the valve needle 10 is maintained in engagement with its seating at this stage of operation. As described hereinbefore, fuel is able to flow between the valve needle 10 and the wall of the bore 12 and into the lower chamber 38 at a restricted rate, and from the lower chamber 38 into the upper chamber 40 via the restricted passage 42. Such flow of fuel increases the fuel pressure acting upon the end surface 10*d* of the valve needle 10, thus assisting the spring 30 in maintaining the valve needle 10 in engagement with its seating as the fuel pressure within the supply passage 18 increases.

If, at this stage in the operation of the injector, the piezoelectric stack 48 has not been energised, energisation of the stack 48 urges the piston member 27 to move downwards. Downward movement of the piston member 27 serves to compress the spring 30 and to decrease the volume of the upper chamber 40 such that fuel pressure within the upper chamber 40 increases. This increase in pressure is transmitted, via the restricted passage 42, into the lower chamber 38 and ensures that the valve needle 10 remains in engagement with its seating. Fuel injection does not therefore take place through either the upper or lower sets of outlet openings.

In order to commence injection, the piezoelectric stack 48 is partially de-energised to a first energisation level, thereby reducing the axial length of the stack 48 and permitting movement of the piston member 27 in an upward direction. The pressure in the upper chamber 40 is relieved and the action of the fuel pressure upon the thrust surfaces 10*c* of the valve needle 10 urges the valve needle 10 away from its seating. The opening movement of the valve needle 10 permits fuel to flow past the seating through the upper set of outlet openings, whilst the lower set of outlet openings remain covered by a lower end region of the valve needle 10. During such opening movement, fuel flows from the lower chamber 38, through the restricted passage 42 and into the upper chamber 40. In this flow direction, the design of the passage 42 is such that there is a relatively large restriction to the flow of fuel, with the result that fuel pressure within the lower control chamber 38 is reduced relatively slowly causing movement of the valve needle 10 into a first fuel injecting position to be damped. As movement of the valve needle 10 slows towards the end of its lift, oscillation of the valve needle 10 when in the first fuel injecting position is reduced or avoided.

In order to terminate injection in normal operation, the piezoelectric stack 48 is re-energised resulting in extension of the stack 48, thereby applying a downwards force to the piston member 27 which increases the fuel pressure within the upper chamber 40, fuel within the upper chamber 40 flowing is through the restricted passage 42 into the lower chamber 38 so as to increase the force applied to the end surface 10*d* of the valve needle 10 due to fuel pressure within the lower chamber 38. The downwardly directed forces applied to the valve needle 10 act against the force applied to the thrust surface 10*c* due to fuel pressure within the bore 12 and are sufficient to urge the needle 10 into engagement with its seating. When the valve needle 10 engages its seating, fuel within the bore 12 is unable to flow out through the upper set of outlet openings and fuel injection ceases.

Alternatively, in order to inject fuel at an increased rate, or with a different fuel injection characteristic, the piezoelectric stack 48 may be de-energised further to a second energisation level, thereby reducing the axial length of the piezoelectric stack 48 further. The piston member 27 is therefore moved upwardly by a further amount, causing fuel pressure within the upper chamber 40 to be reduced further. Fuel within the lower chamber 38 flows into the upper chamber 40 via the restricted passage 42 so as to reduce the fuel pressure within the lower chamber 38 which acts on the end surface 10*d* of the valve needle 10, thereby reducing further the downwards force applied to the valve needle 10. The valve needle 10 therefore moves away from the seating by a further amount into a second fuel injecting position in which both the upper and lower sets of outlet openings are uncovered by the valve needle 10, fuel within the bore 12 therefore being delivered through both sets of outlet openings. Fuel injection therefore takes place at an increased rate.

As described previously, during such further opening movement of the valve needle 10, as there is a relatively large restriction to the flow of fuel from the lower chamber 38 to the upper chamber 40 through the restricted passage 42, fuel pressure within the control chamber reduces at a relatively low rate. The valve needle 10 therefore moves into the second fuel injecting position at a reduced rate, damped movement of the valve needle resulting in the reduction or avoidance of valve needle oscillations when in the second fuel injecting position.

By damping movement of the valve needle away from its seating, the first and second sets of outlet openings can be arranged such that the valve needle need only be moved away from the seating by a relatively small amount into the first or second fuel injecting position. In addition, the invention provides the further advantage that the amplitude of the pressure waves which are transmitted through the supply passage 18 are reduced due to the provision of the restricted passage 18*a*. The dimensions of the restricted passage 18*a* are chosen to ensure that there is no substantial reduction in fuel pressure across the restricted passage 18*a*.

The embodiment of the invention shown in FIG. 2 is economical to manufacture as the restricted passage 42 is of a relatively simple, stepped-orifice form. However, the flow of fuel from the upper chamber 40 to the lower chamber 38 is also restricted to some extent such that movement of the valve needle 10 against its seating to cease fuel injection will also be damped to some extent. This may be undesirable in some applications.

Figure 3:
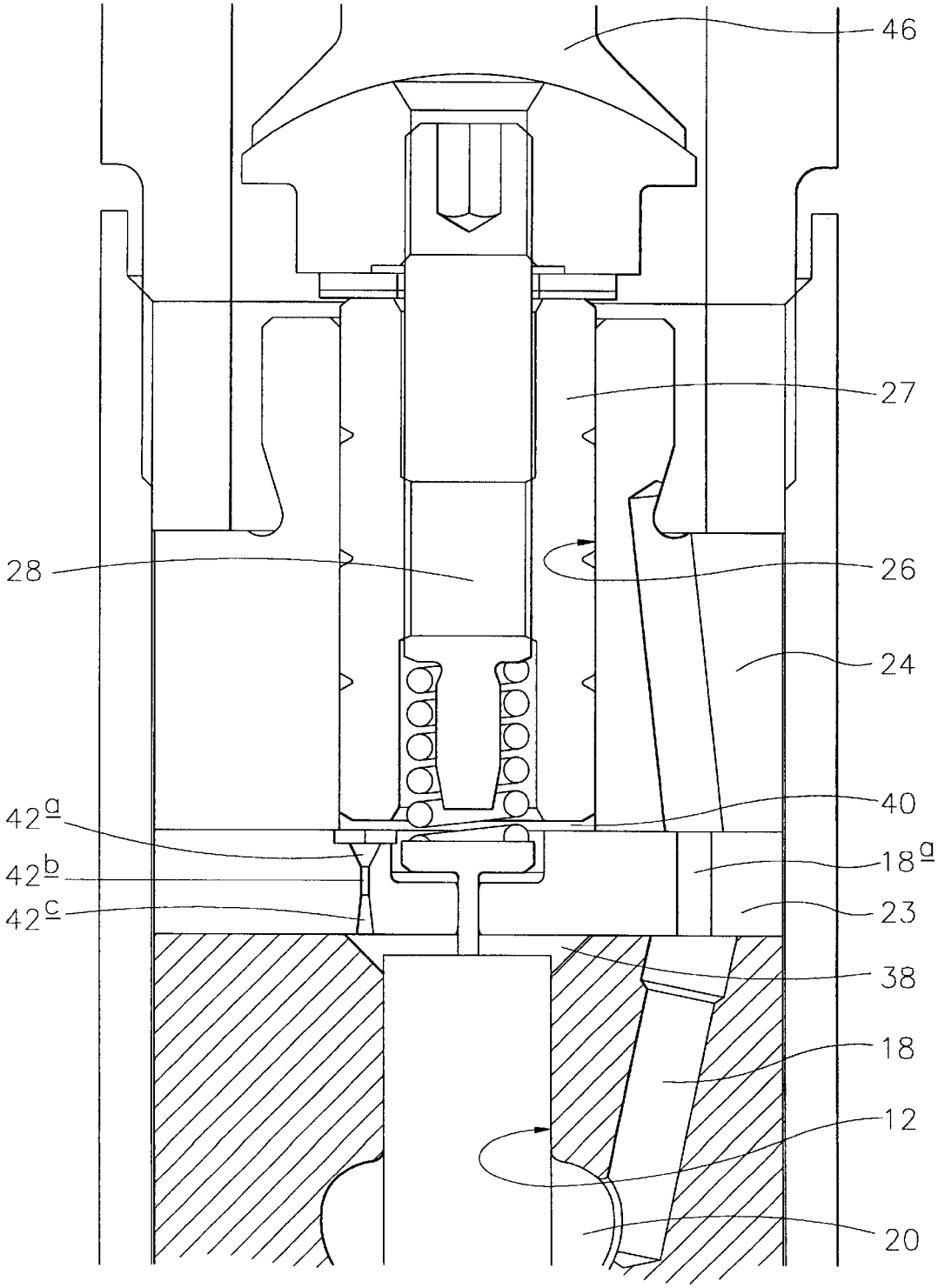
FIG. 3 is a view illustrating an alternative embodiment of the fuel injector of the present invention.

In the embodiment in FIG. 3, similar parts to those of the injector in FIGS. 1 and 2 are denoted by the same reference numerals. In this embodiment, the restricted flow passage 42 is a venturi-type flow passage which provides a more directional flow characteristic. The restricted passage includes an upper end region 42*a* of substantially conical form, a central region 42*b* and a lower end region 42*c* of substantially conical form. Typically, the cone-angle of the upper end region is between 40–90 degrees. The cone-angle of the lower end region 42*c* is typically less than 20 degrees.

Operation of the fuel injector in FIG. 3 occurs in substantially the way as described previously. Thus, energisation of the piezoelectric stack 48 causes downward movement of the piston member 27, causing fuel within the upper chamber 40 to flow into the lower chamber 38. In such circumstances, the flow of fuel from the upper chamber to the lower chamber is restricted by a relatively small amount due to the relatively large cone angle of the upper region 42*a* of the passage 42. Thus, damping of the movement of the valve needle 10 when it is moved towards its seating is relatively small. Furthermore, exit losses are minimised due to the relatively small cone angle of the lower end region 42*c*. When the piezoelectric actuator is de-energised to the first or second energisation level, causing the piston member 27 to move upwardly within the bore 26, fuel pressure within the upper chamber 40 is reduced and fuel flows from the lower chamber 38 to the upper chamber 40 through the restricted passage. As the cone angle of the lower end region 42*c* is relatively small, fuel flow in this direction is restricted by a relatively large amount. Thus, movement of the valve needle 10 in an upwards direction, into the first or second fuel injecting position, is damped by a relatively large amount. Furthermore, exit losses are maximised due to the relatively large cone angle of the upper region 42*a*. The restricted passage 42 shown in FIG. 3 may be formed by a conventional EDM process or by providing a drilling through the dividing piece 23, the drilling being shaped to define the upper end region 42*a* and the control region 42*b*, and then wire-eroding the lower region 42*c* of relatively small cone angle.

Although the restricted flow path by which fuel flows to the recess 14*a* is defined by the needle 10 and the adjacent part of the wall of the bore 12, it will be appreciated that a separate drilling may be provided, if desired, to provide such a restricted flow path.

It will be appreciated that the restricted passage 42 may take an alternative form to that shown in the accompanying figures in order to provide a restricted flow passage to fuel flow between the upper and lower chambers to provide damping movement of the valve needle 10, and preferably to provide damping of movement of the valve needle 10 by a greater amount when the valve needle 10 is moving away from the seating compared with damping of movement when the valve needle 10 is moved towards its seating.

It will be appreciated that the fuel injector of the present invention may also be provided with a third or further set of outlet openings, the piezoelectric actuator being arrange to permit movement of the valve needle into third or further fuel injecting positions. The sets of outlet openings may include a different number of outlet openings, or may include openings having a different size or being arranges to have different fuel spray cone angles to permit the fuel injection rate or other injection characteristic to be varied, in use.

What is claimed is:

1. A fuel injector comprising a valve needle which is slidable within a bore and engageable with a seating to control fuel delivery through first and second outlet openings, the valve needle being moveable between a closed position and first and second fuel injecting positions, a fuel supply passage for supplying fuel under pressure to the bore, a control chamber which is arranged to receive fuel from the fuel passage, in use, the valve needle being acted upon in use by a force due to fuel pressure within the control chamber, an actuator arrangement for controlling fuel pressure within the control chamber, and a damping arrangement for damping movement of the valve needle away from the seating into the first or second fuel injecting position wherein the damping effect on the valve needle movement away from the seating is greater than the damping effect toward the seating.

2. The fuel injector as claimed in claim 1, wherein the injector is arranged such that movement of the valve needle away from the seating into the first fuel injecting position causes fuel to be delivered through the first outlet opening and movement of the valve needle away from the seating into the second fuel injecting position causes fuel to be delivered through the first and second outlet openings.

3. A fuel injector comprising a valve needle which is slidable within a bore and engageable with a seating to control fuel delivery through first and second outlet openings, the valve needle being moveable between a closed position and first and second fuel injecting positions, a fuel supply passage for supplying fuel under pressure to the bore, a control chamber which is arranged to receive fuel from the fuel passage, in use, the valve needle being acted upon in use by a force due to fuel pressure within the control chamber, an actuator arrangement for controlling fuel pressure within the control chamber, and a damping arrangement for damping movement of the valve needle away from the seating into the first or second fuel injecting position wherein the control chamber comprises a first chamber associated with the valve needle and a second chamber associated with the actuator arrangement, and wherein the damping arrangement includes a flow restrictor which serves to restrict the flow of fuel, in use, from the first chamber to the second chamber.

4. The fuel injector as claimed in claim 3, wherein a surface of the valve needle is exposed to fuel pressure within the first chamber, a force due to fuel pressure within the first chamber acting on the valve needle to urge the valve needle against its seating.

5. The fuel injector as claimed in claim 1, wherein the actuator arrangement includes a piston member, a surface of the piston member being exposed to fuel within the second chamber.

6. The fuel injector as claimed in claim 3, wherein the first and second control chambers and the flow restrictor are arranged such that, in use, flow of fuel between the first and second chambers takes place through the flow restrictor.

7. The fuel injector as claimed in claim 6, wherein the flow restrictor is arranged such that there is a relatively lower restriction to fuel flow from the second chamber to the first chamber than from the first chamber to the second chamber.

8. The fuel injector as claimed in any of claims 3, wherein the flow restrictor is defined by a drilling provided in a housing part.

9. The fuel injector as claimed in claim 3, wherein the flow restrictor is a restricted flow passage of stepped form.

10. The fuel injector as claimed in claim 3, wherein the restrictor is a venturi-type flow passage.

11. The fuel injector as claimed in claim 10, wherein the flow passage includes an upper end region of substantially conical form, an intermediate region, and a lower region of substantially conical form, wherein the cone angle of the upper end region is between 40 and 90 degrees.

12. The fuel injector as claimed in claim 11, wherein the cone angle of the lower end region of the flow passage is less than 20 degrees.

13. The fuel injector as claimed in claim 1, wherein fuel is supplied to the control chamber through a restricted flow path defined between the valve needle and the bore.

14. The fuel injector as claimed in claim 1, wherein the supply passage includes an additional restricted flow passage which serves to limit the amplitude of pressure waves within the supply passage.

15. A fuel injector comprising a valve needle which is slidable within a bore and engageable with a seating to control fuel delivery through first outlet openings and an inner valve needle which is movable within the valve needle upon movement of the valve needle away from the seating beyond a predetermined amount, the inner valve needle being engageable with a further seating to control fuel flow through the second outlet opening, the valve needles being moveable between a closed position and first and second fuel injecting positions, a fuel supply passage for supplying fuel under pressure to the bore, a control chamber which is arranged to receive fuel from the fuel passage, in use, the valve needle being acted upon in use by a force due to fuel pressure within the control chamber, an actuator arrangement for controlling fuel pressure within the control chamber, and a damping arrangement for damping movement of the valve needles away from the seating into the first or second fuel injecting position.

16. A fuel injector comprising a valve needle which is slidable within a bore and engageable with a seating to control fuel delivery through an outlet opening, a fuel supply passage for supplying fuel under pressure to the bore, a control chamber which is arranged to receive fuel from the supply passage, in use, the valve needle being acted upon in use by fuel pressure within the control chamber such that the valve needle is damped greater when moving from a closed position to a fuel delivery position than in an opposite direction, an actuator arrangement for controlling fuel pressure within the control chamber, wherein the supply passage for supplying fuel to the bore includes an additional restricted flow passage which serves to limit the amplitude of pressure waves within the supply passage.

* * * * *